United States Patent [19]

Long

[11] Patent Number: 4,781,300

[45] Date of Patent: Nov. 1, 1988

[54] FOLDING BASKET FOR LAUNDRY AND OTHER USES

[76] Inventor: Florence M. Long, 12506 W. Virginia Ave., Lakewood, Colo. 80228

[21] Appl. No.: 39,080

[22] Filed: Apr. 16, 1987

[51] Int. Cl.[4] ..... B65D 21/00

[52] U.S. Cl. ..... 220/7; 220/6

[58] Field of Search ..... 220/7, 6, 4 F, 1.5

[56] References Cited

U.S. PATENT DOCUMENTS

| | | | |
|---|---|---|---|
| 1,822,448 | 9/1931 | Morin | 220/6 X |
| 3,446,415 | 5/1969 | Bromley | 220/7 X |
| 3,497,127 | 2/1970 | Box | 220/6 X |
| 3,955,703 | 5/1976 | Zebarth | 220/6 |
| 4,044,910 | 8/1977 | Box | 220/6 X |

*Primary Examiner*—Steven M. Pollard

[57] ABSTRACT

The present invention provides a collapsible laundry basket comprised of two end walls and two side walls, each of which are hinged at their bottoms to a base member. Each wall member has a snap lock extending along the entire length of each verticle edge allowing the wall members to be locked in an upright position when the basket is assembled for use.

5 Claims, 2 Drawing Sheets

FOLDING BASKET FOR LAUNDRY AND OTHER USES

BACKGROUND

1. Field of Invention

This invention relates to laundry baskets, especially to laundry baskets for use in travel or other situations where space is restricted, facilitating easy storage capabilities when not in use.

2. Description of Prior Art

To date a wide variety of baskets have been made which are bulky and difficult to store. Most users, therefore, would find it desirable to have a basket that folds. An example of users that would benefit from a folding basket are; owners of motor homes, travel trailers, and apartment dwellers. All have in common limited storage space.

OBJECTS AND ADVANTAGES

Accordingly I claim the following as my objects and advantages: a basket that can be easily stored by folding the sides and ends, then when needed, the sides and ends can be quickly snapped back together. The basket can be made of light weight plastic or other appropriate material. Readers will find further objects and advantages of the invention from consideration of ensuing description and the accompanying drawings.

DRAWING FIGURES

FIG. 1 is a perspective view of a laundry basket or similar article showing my new design.

FIG. 2 shows a folded view. This view shows that the sides and ends angle outward from the bottom thus making the dimensions of the basket larger at the top. Due to the angle, both ends and sides will not fold over the bottom of the basket together. Either the ends or the sides will have to fold under the bottom of the basket.

Figure 1:
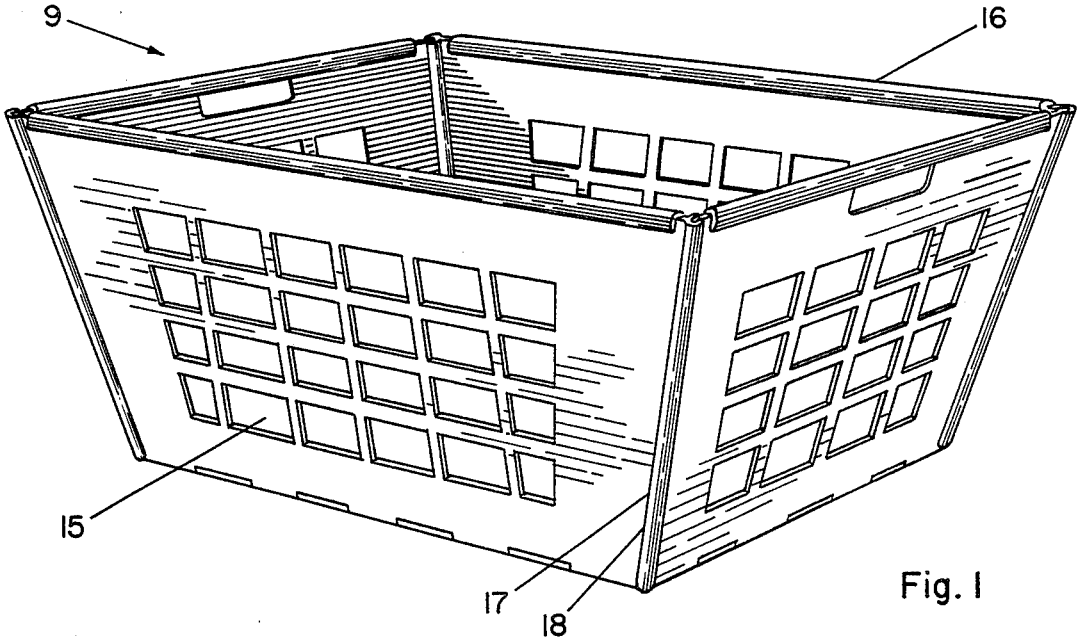
Figure 2:
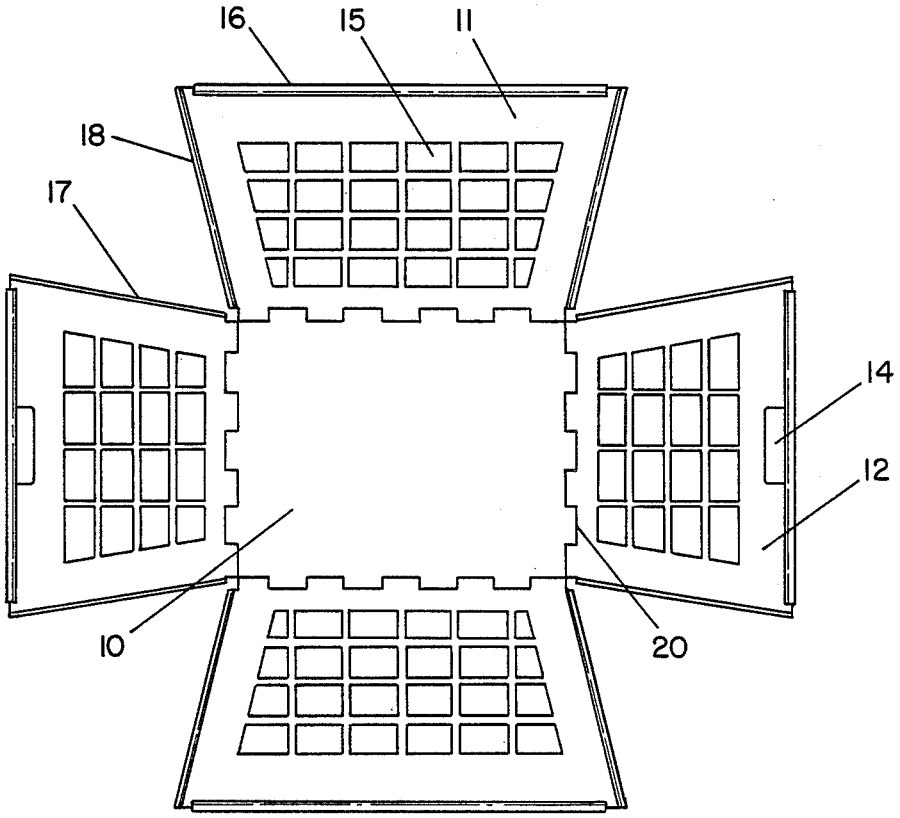
Figure 3:
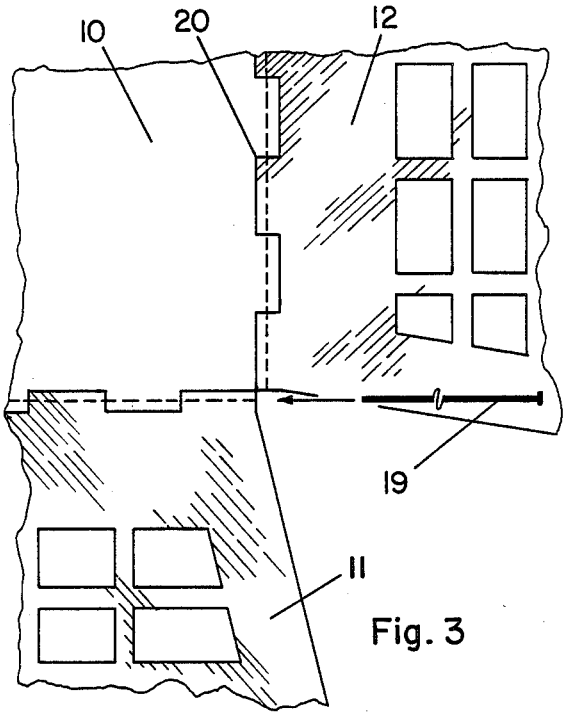
FIG. 3 is a view of the hinge which is shown as a means of holding the basket together and allowing it to fold. A dowel is inserted to hold the bottom and sides together and the bottom and ends together.
Figure 4:
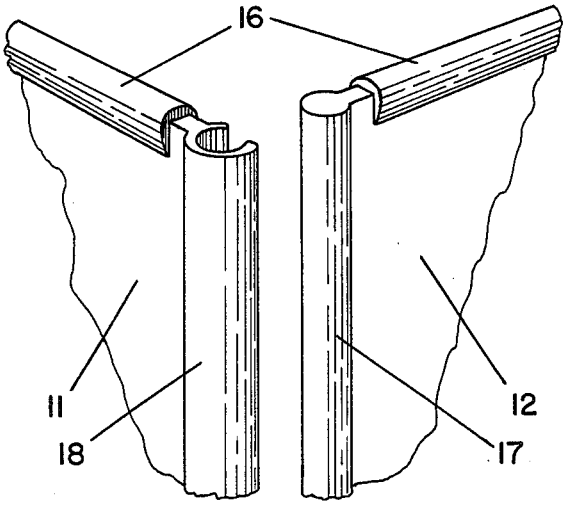
FIG. 4 is a view of a snap lock as a means of holding the ends and sides together. This view is enlarged for viewing clarity.
Figure 5:
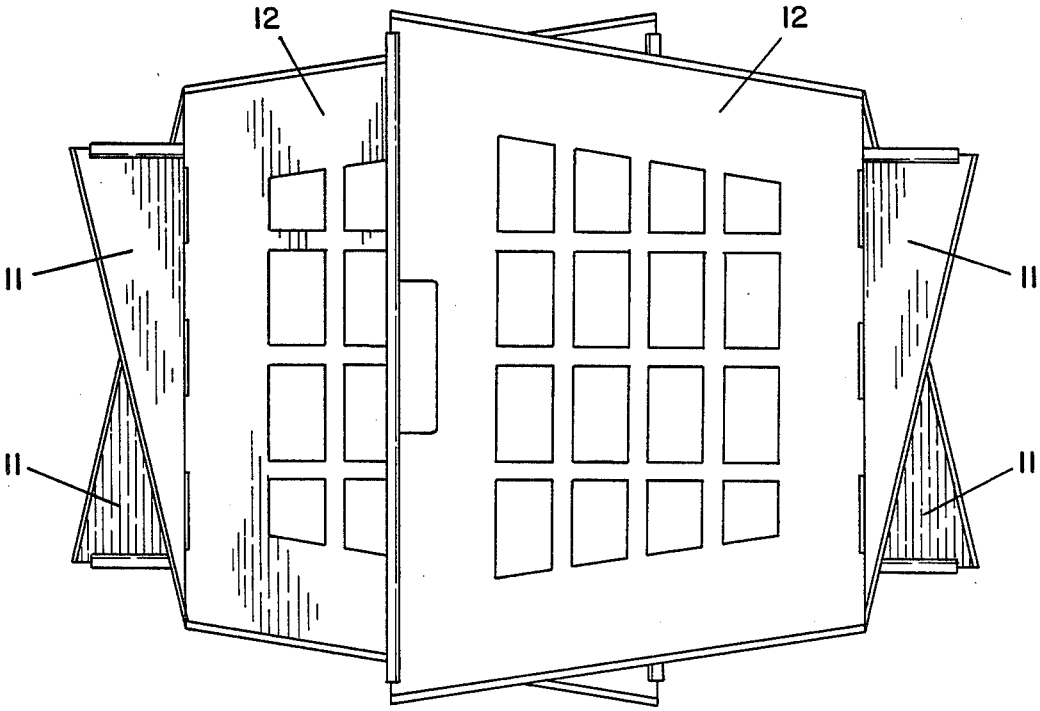

Refer to disclosure document #156247 dated Sept. 22, 1986.

I claim:

1. A collapsible laundry basket comprising a bottom portion having hinges attached to or molded with the bottom portion, two side wall members which fold under the bottom portion and two end wall members which fold on top of the bottom portion when the basket is in its collapsed position and snap locks on the vertical edges of said end and side wall members extending the entire length of said wall member edges for locking the wall members in an upright position when assembled for use.

2. The apparatus of claim 1 wherein the bottom portion has attached or molded hinges extending the entire length of the two ends and two sides of said bottom portion.

3. The apparatus of claim 1 wherein said end wall members and side wall members have cooperative snap lock devices on the vertical edges of said side and end wall members extending the entire length of said wall members which lock together when the side and end wall members are erected and snapped together to form said basket ready for use.

4. The apparatus of claim 1 wherein the laundry basket is constructed of plastic resin material such as polystyrene.

5. A collapsible laundry basket for transporting laundry comprising a base portion having hinges integrally attached or molded to the two sides and two ends, two inwardly folding side members and two outwardly folding end members, said side members folding on top of the base portion and said end members folding on the bottom of the base portion when said basket is in its collapsed position and cooperating snap locks extending the entire length of the edges of the vertical end and side wall portions for holding the wall members in a locked upright position when said basket is erected for use.

* * * * *